United States Patent [19]

Whang

[11] Patent Number: 4,512,826

[45] Date of Patent: Apr. 23, 1985

[54] PRECIPITATE HARDENED TITANIUM ALLOY COMPOSITION AND METHOD OF MANUFACTURE

[75] Inventor: Sung-Hyun Whang, Brookline, Mass.

[73] Assignee: Northeastern University, Boston, Mass.

[21] Appl. No.: 538,343

[22] Filed: Oct. 3, 1983

[51] Int. Cl.[3] ..... C22C 14/00; C22F 1/18

[52] U.S. Cl. ..... 148/407; 148/158; 420/419

[58] Field of Search ..... 420/417, 418, 419; 148/407.3, 12.7 B, 133, 158, 403

[56] References Cited

U.S. PATENT DOCUMENTS

| | | | |
|---|---|---|---|
| 3,070,468 | 12/1962 | Grant | 148/407 |
| 3,622,406 | 11/1971 | Vordahl | 148/407 |
| 4,149,884 | 4/1979 | Maringer et al. | 148/403 |

FOREIGN PATENT DOCUMENTS

| | | | |
|---|---|---|---|
| 2543893 | 4/1976 | Fed. Rep. of Germany | 420/419 |

OTHER PUBLICATIONS

Metal Abstracts, "Exploratory Study of Laser Processing of Titanium Alloys", No. 12-1648, vol. 15, Oct. 1982.

*Primary Examiner*—Peter K. Skiff

*Attorney, Agent, or Firm*—Weingarten, Schurgin, Gagnebin & Hayes

[57] ABSTRACT

Small amounts of rare earth elements are added to an $\alpha$ or near-$\alpha$ alloy of titanium and IIIA, IVA metals to provide a rare earth/IIIA, IVA metal precipitate during an age hardening heat treatment after rapid solidification of the alloy. Age hardening of the rapidly solidified alloy of $\alpha$ or near $\alpha$-titanium creates a fine, uniform, equidistant, high density, spherical 50-100 Angstrom precipitate of the resulting rare earth/IIIA, IVA metal compound to produce a precipitate-hardened allow with twice the strength of the alloy without rare earth additives. The precipitate hardening which predominates the other hardening processes occurs during the heat treating step after rapid solidification, with the quenching associated with the rapid solidification producing solid solution hardening. In a preferred embodiment, avoidance of segregation is accomplished by limiting the amount of rare earth element concentration below the maximum extended solubility limit, thereby to produce a stable precipitate for providing high strength at high temperatures, with a preferred range of rare earth being between 0.1 at .% and 2% at .%.

22 Claims, 18 Drawing Figures

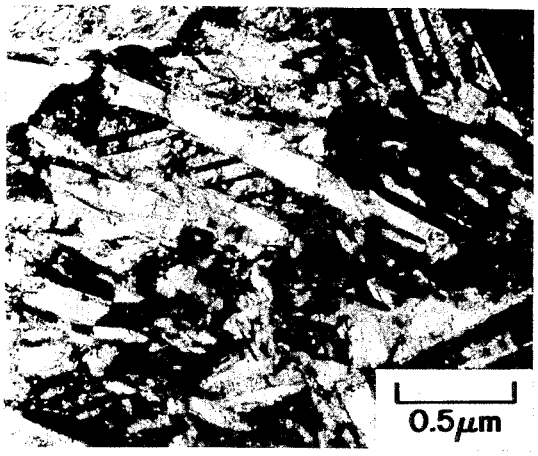
FIG. 1
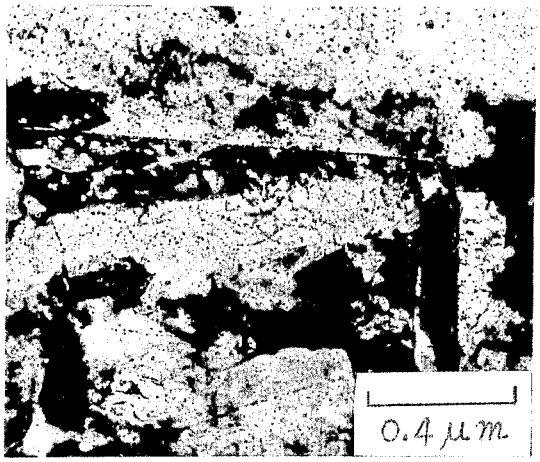
FIG. 2
FIG. 3
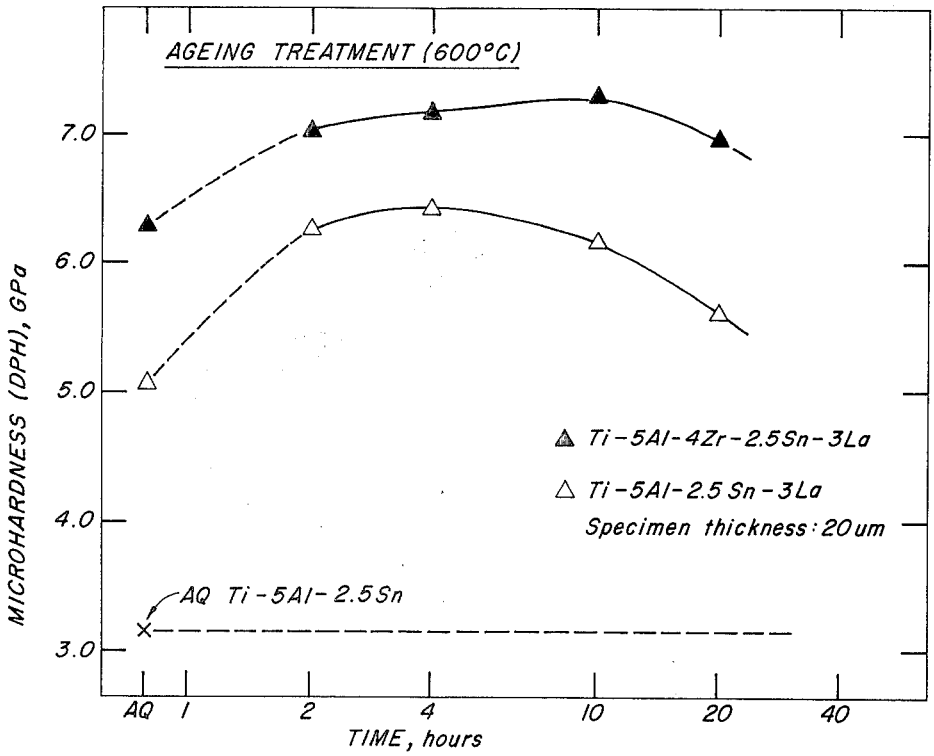

h = hour

PRECIPITATE HARDENED TITANIUM ALLOY COMPOSITION AND METHOD OF MANUFACTURE

This invention was made with Government support under Contract N00014-82-K-0597 awarded by the Department of the Navy.

FIELD OF INVENTION

This invention relates to titanium alloys and more particularly to a high strength, high temperature alloy and its method of manufacture.

BACKGROUND OF THE INVENTION

Rapid solidification (RS) technology in which alloys are rapidly splat quenched produce either amophous metals or metals with microcrystalline structure in which in the as-quenched state (AS), solid solution hardening increases the hardness of the various alloy compositions thus formed. While $\beta$-titanium alloys are widely used in the aircraft industry for structural components, these alloys are not routinely used extensively in high temperature environments, 500°–600° C., for turbine blades and high temperature bearings. Thus, while $\beta$-titanium-aluminium compositions have been used routinely for structural components, such alloys are not capable of being utilized in high temperature environments. On the other hand, $\beta$-titanium alloys have been used in high temperature applications, although their use has been limited due to poor high temperature creep characteristics and other high temperature instability. $\beta$-alloys are those alloys exhibiting hexagonal or near-hexagonal structures and are utilized in high temperature applications whereas the $\beta$-alloys, exhibiting cubic structures, are utilized in the low temperature applications.

Rapid solidification processing (RSP) has proven that the microstructure and mechanical properties of RS alloys have improved a great deal through the processing as demonstrated in Fe, Al, based alloys and superalloys. Nevertheless, little study has been made in Ti alloy systems primarily because of their strong chemical reaction with crucible materials, which has been a stumbling block for the production of research materials. A recent study in this area includes synthesis of RS Ti alloys containing metalloids or pure Ti with rare earth metals (Y, Er) as additives. However, the role of rare earth metals in pure Ti is to form segregated particles or to give off rare earth oxide particles through the reaction with free oxygen.

More specifically, S. M. L. Sastry has reported extensively on the utilization of pure titanium with rare earth metals to provide rare earth oxides which segregate in spherical form within the titanium structure. See for example, "Dispersion Strengthening of Titanium Alloys," S. M. L. Sastry et al., TMS-AIME Fall Meeting, Oct. 25–28, 1982 in which pure titanium containing certain rare earth elements was rapidly solidified by electron beam melting and splat quenching. Note is also made of Sastry's work reported at the same conference in a Sastry paper entitled "Characteristics and Thermal Stability of Dispersed Phases in Rapidly Solidified Titanium-Rare Earth Alloys." Also noted is a paper to Sastry et al. in the 112th Annual Meeting, Mar. 6–10, 1983 of TMS-AIME entitled "Effect of Incoherent Dispersoids on Creep Deformation of Titanium." Moreover, early work of Sastry includes a paper entitled "Influence of Erbium and Yttrium Additions on the Microstructure and Mechanical Properties of Titanium Alloys," pp. 1185–1190, B. B. Rath et al., *Titanium* '80 *Science and Technology,* Proc. IV Conf. on Titanium, May 1980, in which no rapid solidification technology is involved. Sastry's contributions are thus limited to the use of pure titanium to which rare earth elements are added, there being no description of age-hardening due to the lack of chemical reaction between titanium and the rare earths.

More recently it has been reported by Whang et al. in the aforementioned 1982 TMS-AIME Fall Meeting and by Y. Z. Lu and S. H. Whang at the Fall TMS-AIME Meeting in October 1982 that silicon while used in titanium to increase creep resistance, coarsens very quickly such that particles one micron in diameter are produced which result in very little if any strengthening of the material. Moreover, although the addition of silicon to the titanium produces a modest strength improvement, it does not provide an alloy system suitable for use in high temperature applications. High temperature applications include the utilization of these alloy at temperatures exceeding 500° C.

As described by Peng et al. at the TMS-AIME 112th Annual Meeting of Mar. 6–10, 1983 in a paper entitled "Microstructures and Mechanical Properties of Rapidly Solidified Ti-B and Ti-6Al-4V-B Alloys," the use of vanadium with boron produces alloys of titanium boride. However, these alloys are not usable in high temperature applications due to the needle-like martensitic structures produced.

Finally, as reported in *Materials Science and Engineering,* 23 (1976) 135–140, R. Wang describes pure titanium as an additive to rare earth as opposed to rare earth as being an additive to titanium.

It should be noted that titanium alloys have been traditionally strengthened by a solid solution strengthening method in which the strength of the material increases up to a certain temperature at which point it falls off rather rapidly. Thus, solid solution strengthening is not effective at the high temperatures associated with certain aircraft requirements. Titanium strengthening has also been occasionally accomplished by RSP technology along, but this strengthening has not been significant. Moreover, while "so-called" superalloys exist which provide the requisite strength up to 90% of the melting temperature alloy, there are no known superalloy-like compositions for titanium and no known reported precipitation alloy hardening techniques for titanium structures.

In order to provide for high temperature titanium alloys, there is therefore a need for precipitation hardening in which the precipitates or dispersoids, if spherical, if small enough, and if equally distributed, provide barriers which prevent dislocation movement such that the strength of the material is increased. This being the case, the final alloy is provided with much increased strength at high temperatures since the particle effectively blocks dislocation movement. In order to provide a stable precipitation to prevent movement of dislocations, the precipitate must be fine, on the order of 50–100 Angstroms in diameter, uniformly dispersed throughout the material, spherical in structure, and of high density.

SUMMARY OF THE INVENTION

While previously reported titanium alloys have contained small amounts of rare earth elements, none of these alloys have been provided with metals from groups IIIA and IVA of the periodic table. Since these metals react strongly with the rare earth elements it has been found that significant precipitate or age hardening is provided by the heat treatment of rapidly solidified titanium alloys containing IIIA, IVA metals and small amounts of rare earth elements. In the age hardening process precipitates of compounds of the rare earth elements and the IIIA, IVA metals are formed with average diameters ranging from 50–100 Angstroms. It has been found that the precipitated particles are uniformly dispersed throughout the material, are spherical in structure and are of high density. The precipitate thus formed acts to prevent dislocation movement which dramatically increases hardness and creep resistance so that the resulting age hardened alloy is uniquely adapted to high temperature applications.

It should be noted that even absent heat treatment, rapid solidification of a solid solution of titanium, group IIIA, IVA metals, and rare earth elements produces a 20–30% hardness increase over the same alloy without rare earth additives due to solid solution strengthening. The hardness factor produced by these techniques can be increased by a factor of two through the utilization of a heat treatment procedure which provides the required precipitates which are compounds of the rare earth elements and the group IIIA, IVA metals.

More specifically, in one embodiment IIIA, IVA metals, aluminum, germanium and tin are utilized separately or in combination with the titanium. Rare earth elements which have a boiling point higher than the melting point of titanium are then added in small amounts. The following is a list of such rare earth elements:

Y,La,Ce,Pr,Nd,Tb,Dy,Ho,Er,Lu,Th.

While all of the above-noted rare earth elements are utilizable to produce a high temperature titanium alloy, lanthanum is preferred because it has the largest atomic size and because it is relatively cheap. It has been found that the larger the rare earth atom the greater the strength of the final product.

Amounts of rare earth elements utilizable in general are in the range 0.1 at .% to 2 at .%, with too little producing too fine a powder such that the precipitate density is relatively low which produces negligible strength increases. If too large amounts of rare earth elements are utilized, some of the rare earth element does not dissolve which accelerates particle coarsening at high temperatures and makes the corresponding alloy brittle. It is therefore desirable to add an amount of rare earth element below the segregation limit for a given cooling rate which is the maximum extended solid solubility limit associated with rapid solidification. Such a limit is ascertainable experimentally. It is important in the subject system that no segregation takes place, since after aging or heat treatment it is desirable to have precipitates having 50–100 Angstrom diameters. Thus segregation may be avoided by limiting the amount of rare earth element to a maximum of the extended solid solubility limit.

Were segregation allowed to exist by exceeding this limit, then during rapid solidification, particle sizes of 50–100 Angstroms would exist which, during aging, would result in precipitates having average diameters larger than 0.1 micrometers, the precipitates being too coarse to produce strengthening of the final alloy.

Thus, $\alpha$-Ti alloys containing group IIIA and IVA metals and certain rare earth elements form precipitates during heat treatment, which give rise to a strong age hardening. The precipitate takes the form of a compound of group IIIA and IVA elements and rare earth metals. Strength increase is observed in the as-quenched state and the aged state as well, with the as-quenched increase being as much as 30% from that of a standard alloy, as-quenched Ti-5Al-2.5Sn, and with the age hardnened strength increase being as much as twice as the strength of the standard alloy. Strength increase in rapidly solidified $\alpha$-Ti alloys is primarily attributed to precipitation hardening, solid solution hardening and microstructure refinement in that order. Moreover, sample thickness, and therefore cooling rate has been found to be a non-negligible factor in determining the strength of as-quenched and aged alloys.

For purposes of this invention, heat treatment, age hardening, or aging treatment refer to heating the as-quenched alloy between 500° C. and 700° C. for an amount of time sufficient to produce the precipitate in required volume fractions. This can range from 2–10 hours for 500° C.

BRIEF DESCRIPTION OF THE DRAWINGS

These and other features of the invention will be better understood in connection with the detailed description taken in conjunction with the drawings of which:

FIG. 1 is a TEM micrograph of as-quenched Ti-5Al-2.5Sn-3La;

FIG. 2 is a TEM micrograph of age state Ti-5Al-2.5Sn-3La, 700°,2h;

FIG. 3 is a graph of aging treatment of Ti-5Al-4Zr-2.5Sn-3La and Ti-5Al-2.5Sn-3La;

DETAILED DESCRIPTION

Figure 4A:
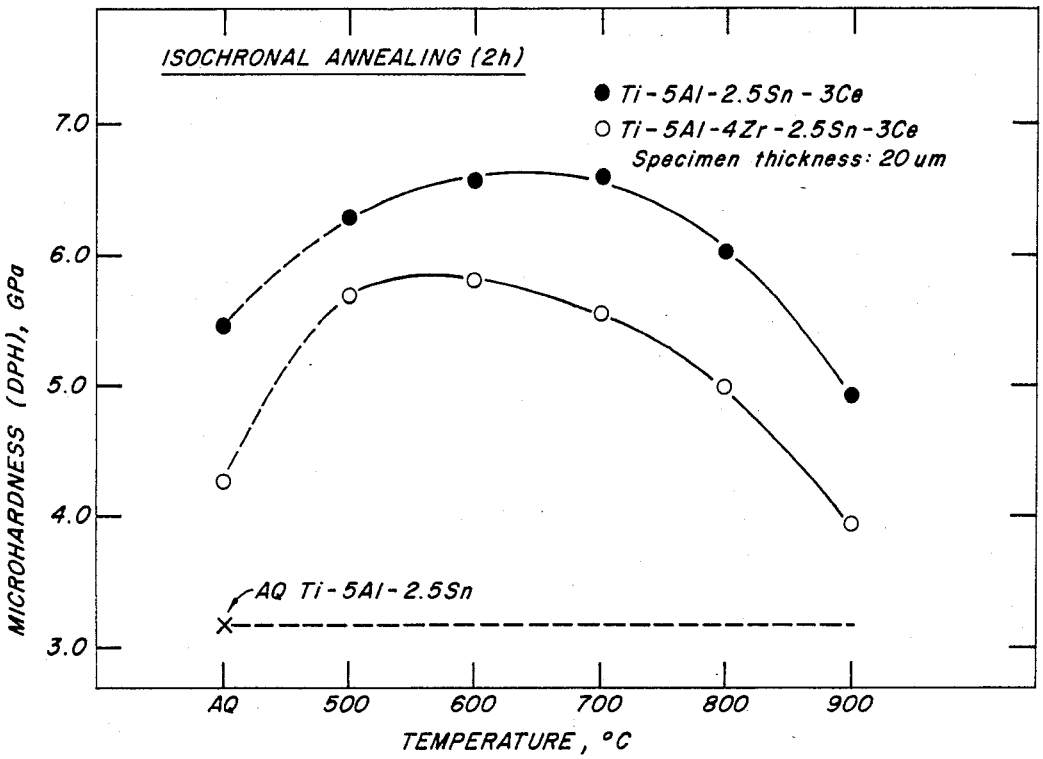
FIGS. 4*a* and 4*b* are graphs of isochromal annealing for 2 hours of Ti-5Al-2.5Sn-3Ce and Ti-5Al-4Zr-2.5Sn-3Ce for two different sample thicknesses.

For high temperature application of titanium alloys, on the order of 500 to 600° C., it has been found that alloy compositions containing certain rare earth additives combined chemically with metals from the IIIA and IVA group, when combined with rapid solidification processing techniques and a subsequent heat treatment step yield precipitates on the order of 50 to 100 Angstroms in diameter which are uniformly distributed within the age hardened alloy in sufficient density to prevent dislocations from moving, thereby providing increased strength and hardness. The high strength and mechanical stability is obtained at elevated temperatures by introducing very fine and thermally stable precipitates during the above-mentioned process. Although this invention incorporates all rare earth elements having boiling points below the melting point of titanium, the following alloy compositions are particularly useful for aircraft turbines and other high temperature applications.

Concentrations:
Al: 1–10 wt %
Zr: 1–5 wt %
Sn: 1–4 wt %
La,Ce: 0.5–6 wt %
Ti: Balance The following alloy compositions were studied and the aged state hardness was measured for some of the alloys listed below:

TABLE 1

| | Alloy Systems | Aged State Hardness |
|---|---|---|
| | Ti—5Al—6Ce | 6.0 |
| | Ti—5Ge—6Ce | |
| | Ti—5Sn—6Ce | |
| | Ti—5Al—2.5Sn—3Ce | 5.64 |
| | Ti—5Al—1La | |
| | Ti—5Al—2La | |
| | Ti—5Al—3La | |
| | Ti—5Al—4La | |
| | Ti—5Al—5La | |
| | Ti—5Al—2.5Sn—3La | 6.53 |
| | Ti—5Al—2.5Sn—4Zr—3La | 7.51 |
| | Ti—5Al—2.5Sn—4Zr—3Ce | 6.53 |
| | Ti—5Al—2.5Sn—2Y | 4.7 |
| | Ti—5Al—2.5Sn—3.2Nd | |
| Standard | Ti—5Al—2.5Sn | 3.2 |

As can be seen, those compounds for which hardness was tested an increase in strength for the aged state over the hardness of Ti-5Al-2.5Sn ranged from 1.5 to 2.3 times the strength of as-quenched Ti-5Al-2.5Sn which was used as a standard for test comparison.

It will be appreciated that zirconium is not a group IIIA or IVA metal and it is therefore within the scope of this invention that other materials may be alloyed with titanium and the IIIA or IVA metals to provide a thermally stable alloy with precipitates which are formed chemically from the reaction of the rare earth element or elements with the IIIA or IVA metal or metals.

Moreover, since the particular alloy composition utilized has associated with it a certain solid solubility which is extended by virture of the splat cooling or rapid solidification technique utilized, the desirable percent by weight of the rare earth additive is such that it is less than the maximum solid solubility percentage which may be established empirically. In a preferred embodiment, either lanthanum or cerium is utilized, with lanthanum being preferred because of the optimal size of the precipitate formed after annealing of the lanthanum/IIIA, IVA compound.

With respect to the processing of the particular alloy, first, a relatively homogeneous alloy is made in an arc melt furnace. Subsequently, the alloys are later melt spun by an arc melt spinner of conventional design. This produces a ribbon or foil which has a thickness of 20 to 30 micrometers (μm) with a cooling rate of approximately $10^6$K/sec.

As illustrated in FIG. 1, a TEM micrograph shows a Ti-5Al-2.5Sn-3La alloy in the as-quenched state. The alloy has an extremely fine microstructure never before observed in conventional titanium alloys. It should be noted from t his micrograph that there is no segregation of the lanthanum.

In the heat treated state, as illustrated by the TEM micrograph of FIG. 2, at 700° C. for 2 hours, tiny dots on the order of 50 to 100 Angstroms appear which are the precipitates of the lanthanum/aluminum-tin compound. In general, the heat treating or age hardening step is one involving a temperature range of between 500°–700° C. with the heat treatment occurring for optimum time. It will be noted that the grain size remains under one micron in diameter with an optimum volume of rare earth compound precipitates inside the grains.

In the embodiment illustrated, the size of the precipitate varies from approximately 100 Angstroms to 0.5 micrometers in diameter. However, the majority of the precipitates are well under 0.1 micrometers in diameter in the 50–100 Angstrom range. Such fine and spherical precipitates which are stable under the high temperature heat treatment conditions have not been found in conventional alloy systems.

With respect to the mechanical properties of the precipitate hardened or age hardened rapid solidified alloys, the strength increases due to the addition of the rare earth element, at approximately one atomic percent when chemically combined with the group IIIA or IVA metals. Prior to annealing, the strength increase is as much as 20–30%. The strength increase after heat treatment depends upon the type of rare earth metals, concentration, and heat treatment condition. The ductility of these alloys is similar to that of the counterpart alloys without the rare earth addition.

Figure 4B:
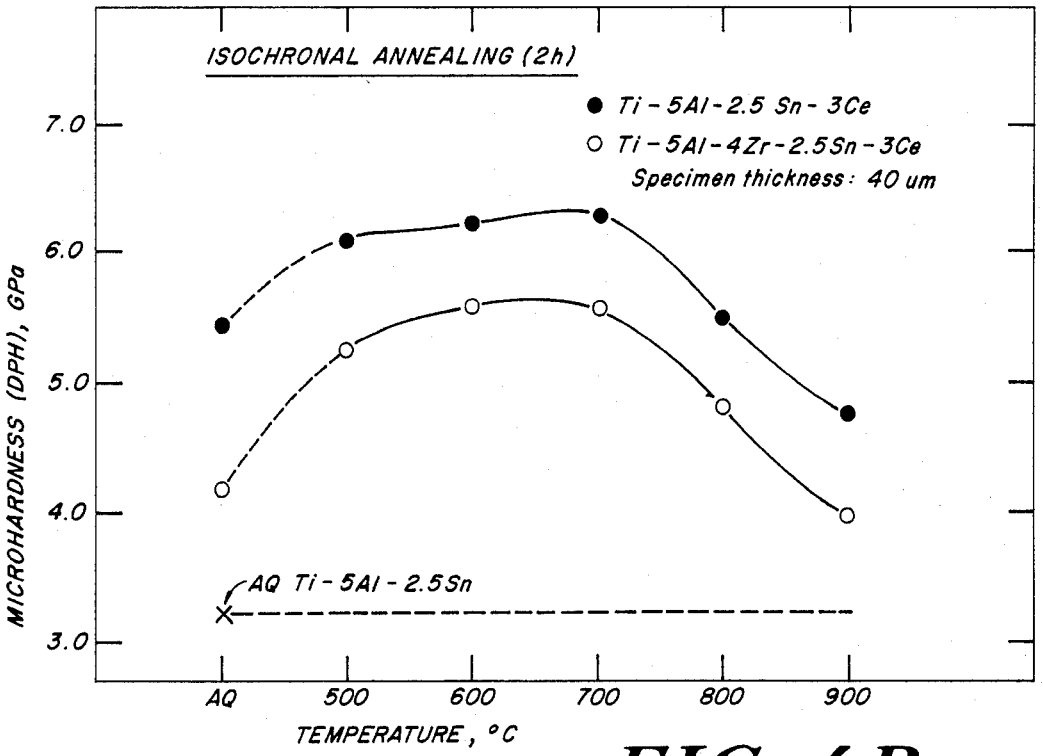

In summary, very fine and spherical shaped precipitates of rare earth metals can be formed by rapid solidification and subsequent heat treatment. Because of the very fine precipitate produced and because the precipitate is both mechanically land thermally stable, the strength increases noted above exist for the entire temperature range of 500°–900° C. The uniqueness of these alloys can be identified by the very fine and spherical shape precipitates, resistance to coarsening of precipitates at elevated temperatures and the resulting high strength. This is shown respectively in the graphs of FIGS. 3 and 4 for aging treatment at 600° C. and isochronal annealing between 500°–900° C. for 2 hours of the indicated alloys.

More specifically with respect to Ce, small amounts of Ce were incorporated in α-Ti based alloys containing aluminum via rapid liquid quenching. Subsequent heat treatment at a temperature range of 500°–700° C. results in a strong aging response in conjunction with uniform and fine dispersoids (~100°A) in the matrix. The strength at the aged state in the alloys containing 1 at %Ce is 6.0 GPa (DPH). Here GPa refers to gigaPascals, a pressure and DPH refers to diamond pyramid hardness. The microstructure of the alloy annealed at 950° C. for 24 hours yields a precipitate large enough to make a spectral analysis. The large precipitate in Ti-Al-Ce after extensive annealing is identified to be Al and Ce rich indicating that the Al-Ce compound is formed in the Ti matrix.

The reactive nature of Ti alloy requires special care during melting, solidification and heat treatment. In particular, serious contamination by crucible materials, electrode, or excessive interstitials (O,N), etc., are subjects of concern. Hence, melting, splatting, and spinning are performed in a cold copper hearth under a positive inert gas atmosphere. Subsequently, for heat treatment, samples are wrapped with tantalum foil and sealed in a quartz tube under vacuum. Microstructure study was carried out either by transmission electron microscopy (TEM), scanning electron microscopy (SEM) and electron microprobe. TEM sample preparation was made by electropolishing using an acid solution or an ion milling technique. Microhardness was measured by Vicker's diamond pyramid hardness tester using 50 g load and 30 sec. duration. The hardness value was determined by averaging more than ten indentations for one specimen. Bend ductility was obtained by measuring the diameter of the half circle of the sample foil at failure. The strain to failure was calculated using an approximate relation. Typical $\alpha$-Ti aloys were selected as base alloys; Ti-Al, Ti-Al-Sn and Ti-Al-Zr-Sn. The amount of Ce in the alloys ranged from 0.5 to 6 wt.%. However, the maximum extended solid solubility of Ce for a cooling rate of $\sim 10^6$K/sec. is $\sim$0.6 at %. Excess addition of these elements results in precipitation ($\sim$50A°) out at subgrain boundaries in the as-quenched state.

The TEM micrograph of quenched Ti alloys (see FIG. 1) from liquid exhibit common features existing in other RS alloys sucgh as microstructural refinement, supersaturated phase, and extremely fine precipitate or cluster if present. Although all rapidly solidified Ti alloys studied share these fundamental characteristics, there is subtle microstructural difference depending on type of additive elements.

Figure 5:
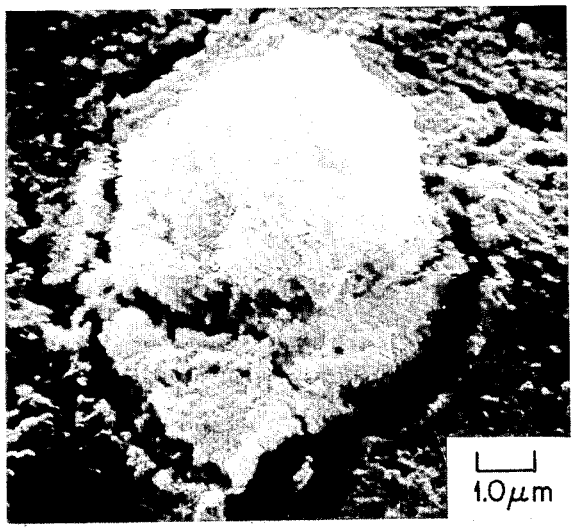
FIG. 5 is a SEM micrograph of a precipitate of Ti-5Al-6Ce annealed at 950° for 24 hours.
Figure 6:
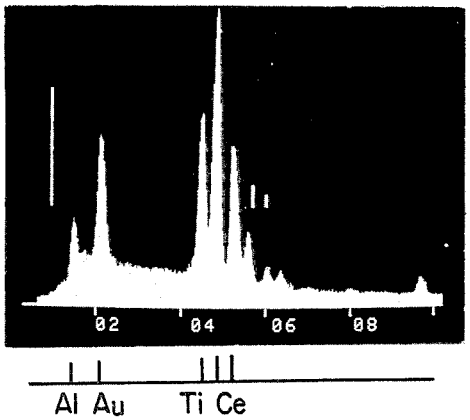
FIG. 6 shows the energy dispersive x-ray spectrum of this FIG. 5 precipitate showing a strong Al and Ce peak.
Figure 7A:
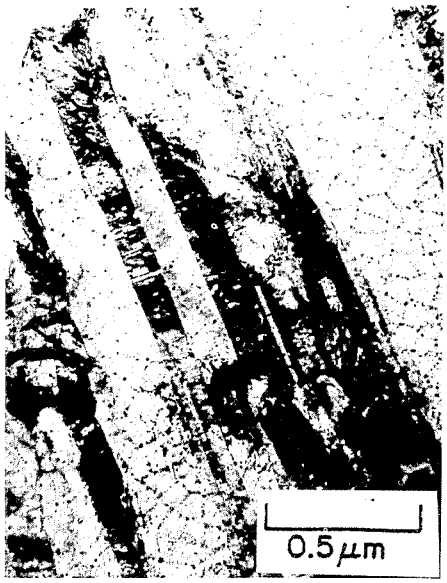
FIG. 7*a* is a bright field TEM micrograph of as-quenched Ti-5Al-2.5Sn-3Ce.
Figure 7B:
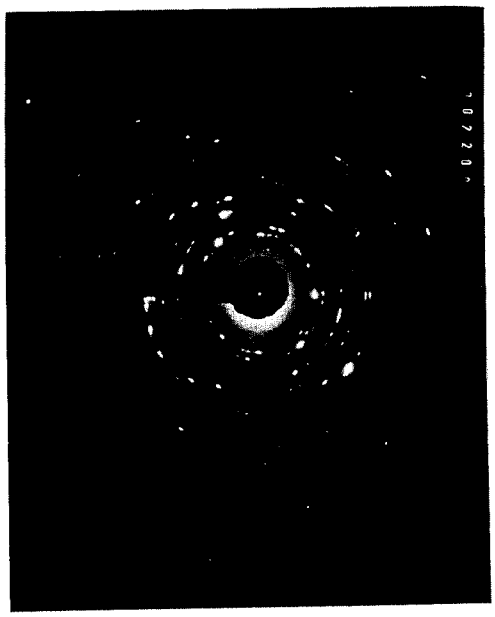
FIG. 7*b* is the associated diffraction pattern of the as-quenched Ti-5Al-2.5Sn-3Ce.
Figure 8A:
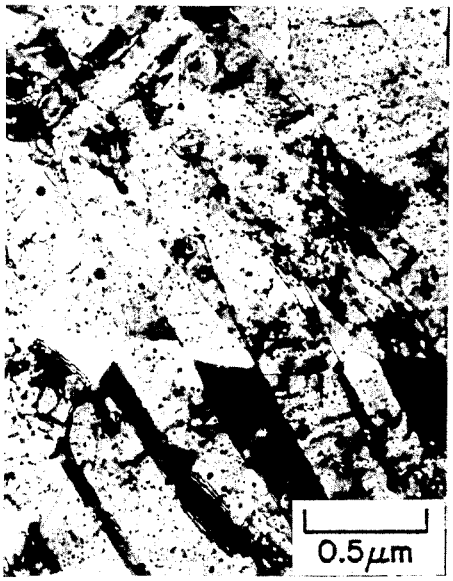
FIG. 8*a* is a bright field micrograph of aged Ti-5Al-2.5Sn-3Ce, annealed at 700° C. for 2 hours.
Figure 8B:
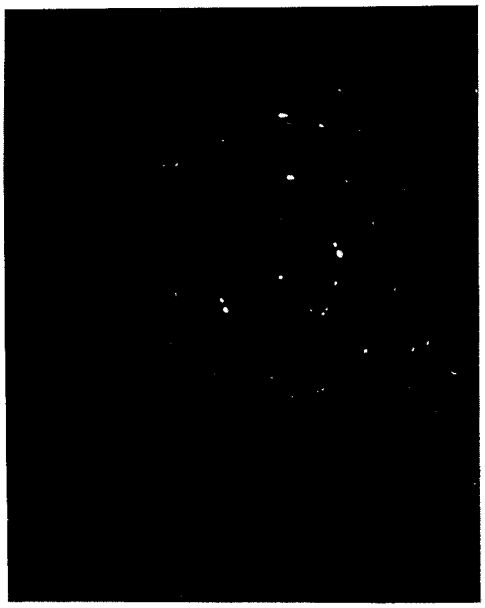
FIG. 8*b* is the associated diffraction pattern of the annealed Ti-5Al-2.5Sn-3Ce.

In order to find the identity of precipitate in this system, Ti-5Al-6Ce was prepared, splat-quenched and annealed at 950° C., 24 h. One of the largest precipitates (FIG. 5) was studied under SEM and checked with energy dispersive x-ray spectroscopy. The spectrum from the precipitate reveals proportionally a strong Al and Ce peak (FIG. 6); whereas little Al and almost negligible Ce are present in the spectrum from the matrix. This indicates that the precipitate takes the form of compounds existing in the binary Al-Ce phase diagram. A practical alloy, Ti-6Al-2.5Sn-3Ce, was examined by TEM with respect to different stages of heat treatment. FIGS. *7a* and *7b* FIGS. *8a* *8b* show the bright field micrograph of the as-quenched alloy and aged state alloy respectively and its diffraction pattern. As can be seen, a Ce deposit occurs along subgrain boundaries due to excess addition of Ce. However, the alloy containing 1.5 wt % Ce does not reveal any Ce deposit.

Figure 9:
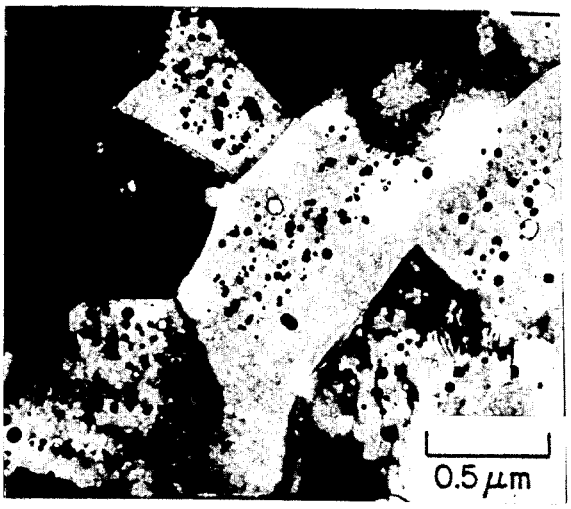
FIG. 9 is a bright field micrograph of annealed Ti-5Al-2.5Sn-3Ce annealed at 900° C. for 2 hours.

The aged Ti-5Al-2.5Sn-3Ce specimen shown in FIG. 9 exhibits a very fine precipitate of $\sim$100 A° in diameter preceded by the disappearance of subgrain boundary. In general, the precipitate is uniformly distributed without preference.

To examine the coarsening of the particle, the Ti-5Al-2.5Sn-3Ce alloy was annealed at 900° C., 2h shown in FIG. 9. The size of the particle is still less than 0.1 $\mu$m, but preciptate freeze zone (PFZ) starts to appear along grain boundaries.

Although pure titanium containing rare earth metals via rapid solidification has been reported, no precipitation hardening of alpha-Ti alloys was investigated. Here the age hardening phenomenon in Ti alloys containing group IIIA and IVA metals together with rare earth metals has been found.

Figure 10:
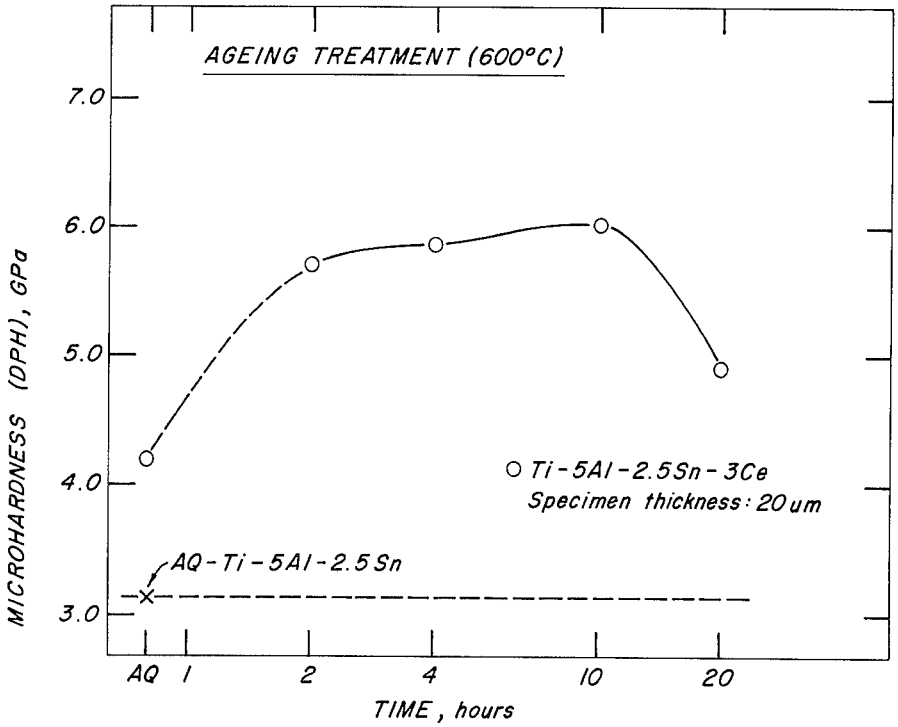
FIG. 10 is a graph illustrating the strength increase for Ti-5Al-2.5Sn-3Ce.

The addition of small quantities of group IIIA and IVA metals and rare earth elements in the form of a supersaturated solid solution as shown in FIG. 10 for the as-quenched state leads to a dramatic strength increase primarily due to solid solution strengthening and to lesser extent due to microstructural refinement. The increase is 30% for the Cε containing alloy from the as-quenched Ti-5Al-2.5Sn alloy. Also, it is noted that Zr addition increases strength due to alloying effect.

Beyond solid solution hardening, it is important to understand the precipitation behavior of $\alpha$-Ti alloys containing simple metals and rare earth elements. The large electronegativity difference between the group IIIA, IVA and RE metals results in very stable compound formation in a binary alloy system. In FIG. 10, the alloy was aged at 600° C. as a function of time. The Ce containing alloy shows strong hardening effects which is consistent with microstructural observation in FIG. 9. The hardness increase in the aged alloy is as much as 20–40% from the as-quenched state. Therefore, the maximum strength at the aged state is as much as twice that of as-quenched Ti-5Al-2.5Sn.

Figure 11:
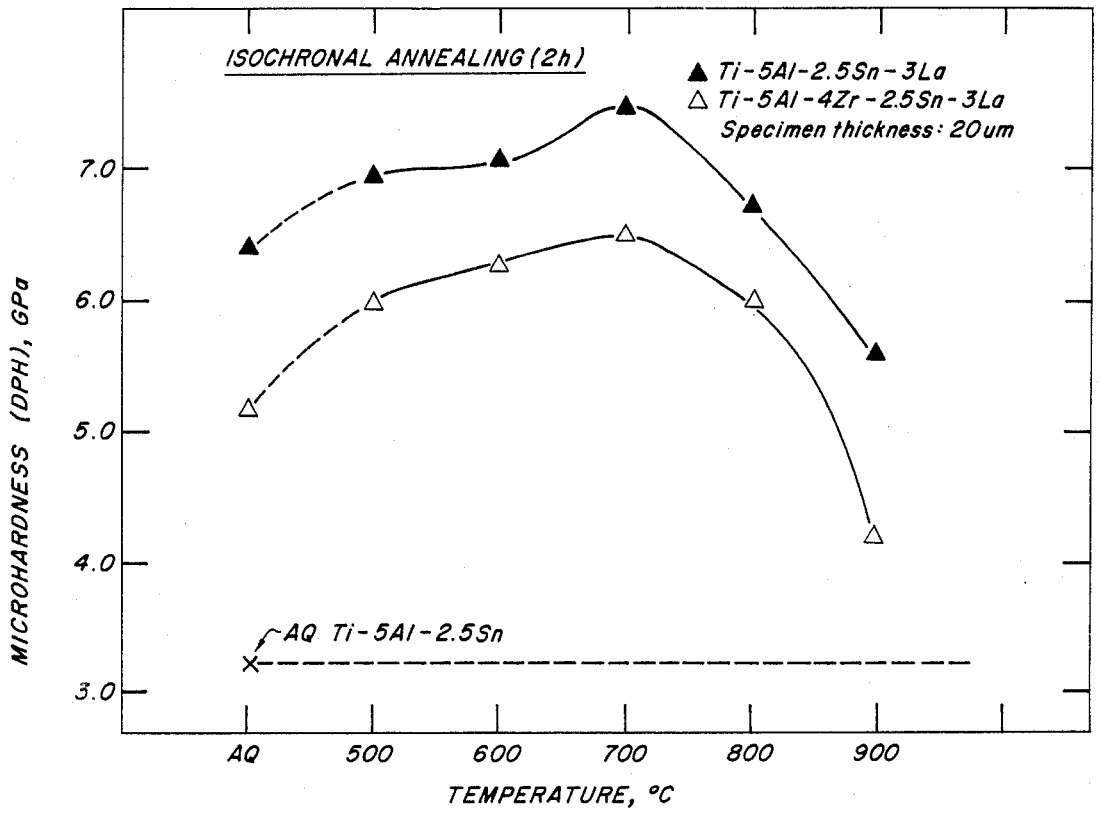
FIG. 11 is a graph illustrating isochronal annealing for 2 hours at temperatures from 500° C. to 900° C. for a 20$\mu$ thick sample of Ti-5Al-2.5Sn-3La and Ti-5Al-4Zr-2.5Sn-3La.
Figure 12:
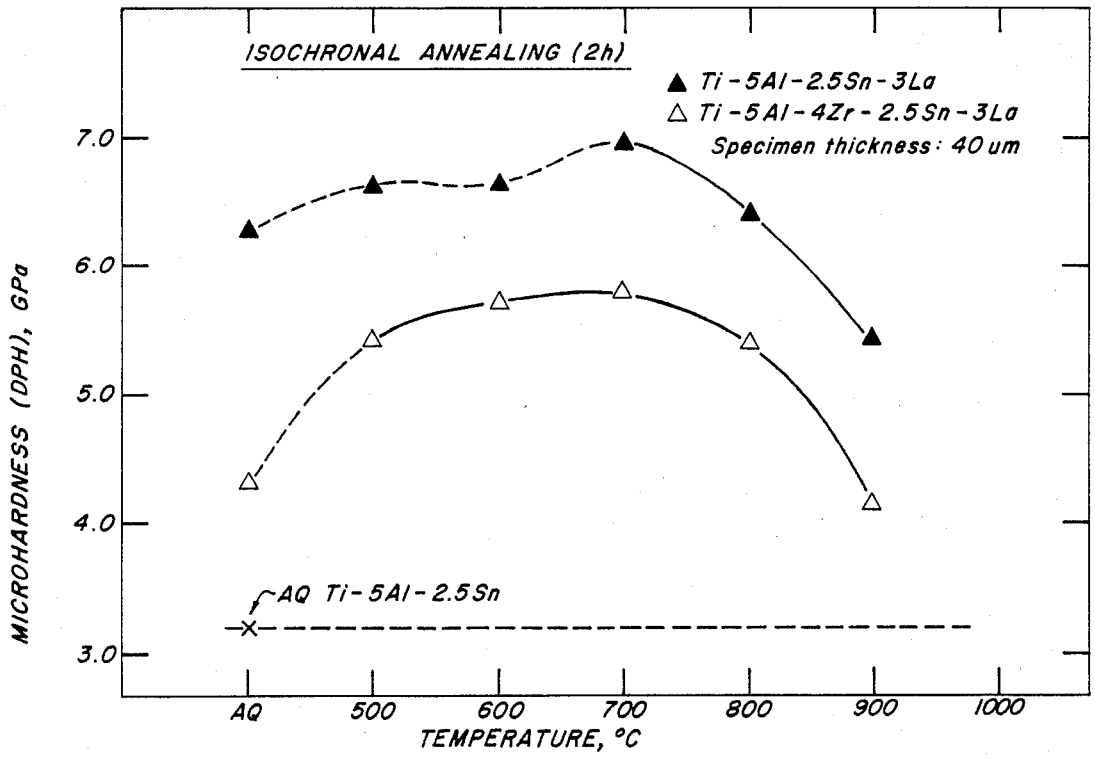
FIG. 12 is a graph illustrating isochronal annealing for 2 hours of temperatures from 500° C. to 900° C. for a 40$\mu$ thick sample of the alloy of FIG. 11.

Referring to FIGS. 11 and 12, to conduct isochronal annealing of Ti-5Al-2.5Sn-3La and Ti-5Al-2.5Sn-4Zr-3La, each specimen was annealed for two hours at temperatures from 500° C. to 900° C. Also, this annealing experiment was performed on the indicated two groups of samples, i.e. 20 $\mu$m thick (FIG. 11) and 40 $\mu$m thick (FIG. 12). By and large, maximum strength occurs at 700° C. and softening of strength starts at 800° C.

Figure 13:
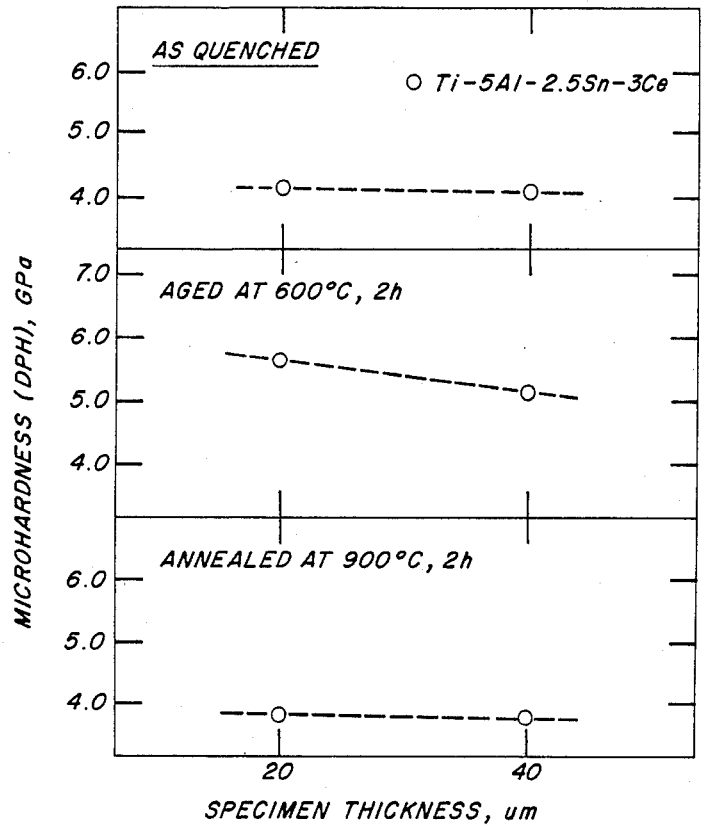
FIG. 13 is a graph showing thickness dependence of hardness for Ti-5Al-2.5Sn-3Ce.

For the entire temperature range, the thinner sample maintains higher strength than the thicker one. The thickness of the sample is inversely proportional to the cooling rate, which in turn is related to degree of supersaturation and microstrucural refinement. FIG. 13 shows thickness dependence of hardness, in which the hardness change is only 10% for going from a thick sample to a thin sample. In particular, the difference in the hardness dependence on thickness is dramatic between the as-quenched and aged stages.

Figure 14:
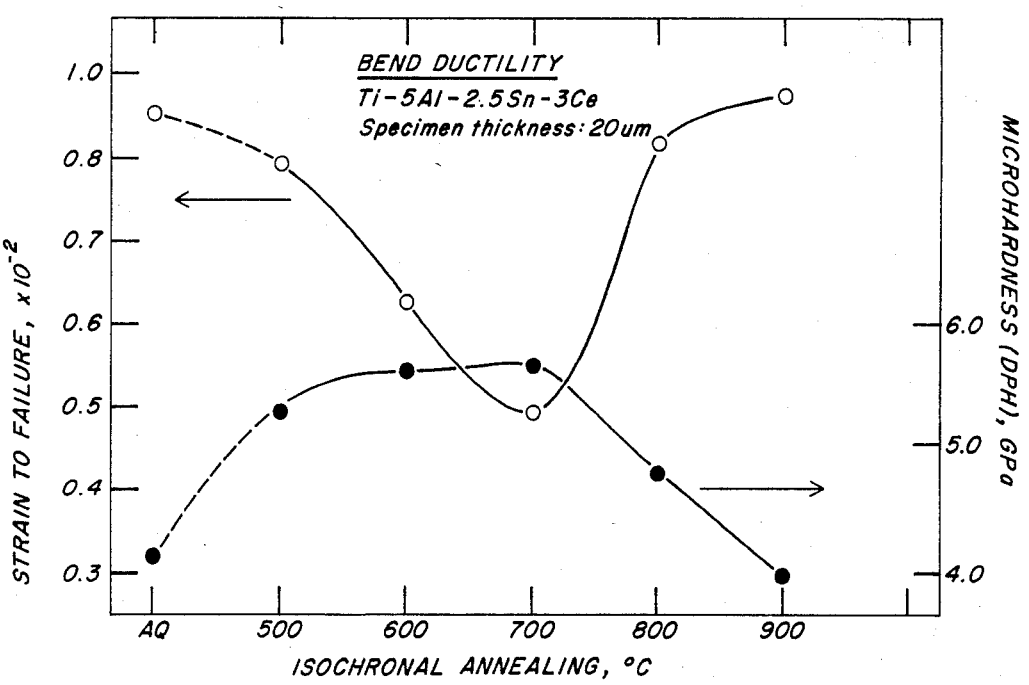
FIG. 14 is a graph illustrating ductility of Ti-5Al-2Sn-3Ce.

Ductility is one of the important parameters used to evaluate the suitability of an alloy for practical use. However, the geometry of the sample restricts testing to a limited test, i.e., bend ductility. As illustrated in FIG. 14, as strength increases due to age hardening, the bend ductility conversely rapidly declines. The maximum strength and minimum ductility is in accordance with the data presented in FIG. 14.

Titanium alloys containing rare earth metals have different aspects from those containing metalloids in terms of alloy chemistry. The rare earth elements have very limited solubility in titanium due to their large atomic size, the size difference being more than 15%. Secondly, the chemical interaction between the rare earth element and titanium is insignificant while that between the metalloid and titanium is strong due to a large electronegativity difference.

Thus, in Ti-Ce alloys a very stable miscibility gap is found. Also, the maximum extended solid solubility of Ce in Ti is less than three times that of maximum equilibrium value, which is the lowest limit for rapidly solidified alloys in general. The reason for this is due to the fact that in Ti-Ce as a monotectic system, the liquid-solid mix zone between horizontal liquidus and solidus lines is very large. This makes it difficult for additive atoms to remain unsegregated during rapid cooling.

An interesting fact is that strength in the aged state appears to be related to atomic size of the rare earth element. For instance, the descending order of atomic size as well as strength of the aged state of the alloy is La, Ce, Y. Age hardening also was obtained when Al was replaced by Sn or Ge, since these elements interact with rare earth metals in a similar manner.

It will be noted that Ti alloys containing silicon are not desirable because of silicon coarsening during high temperature treatment, whereas boron is undesirable because of the needle-like shape of the precipitate and the resulting brittleness.

Figure 15:
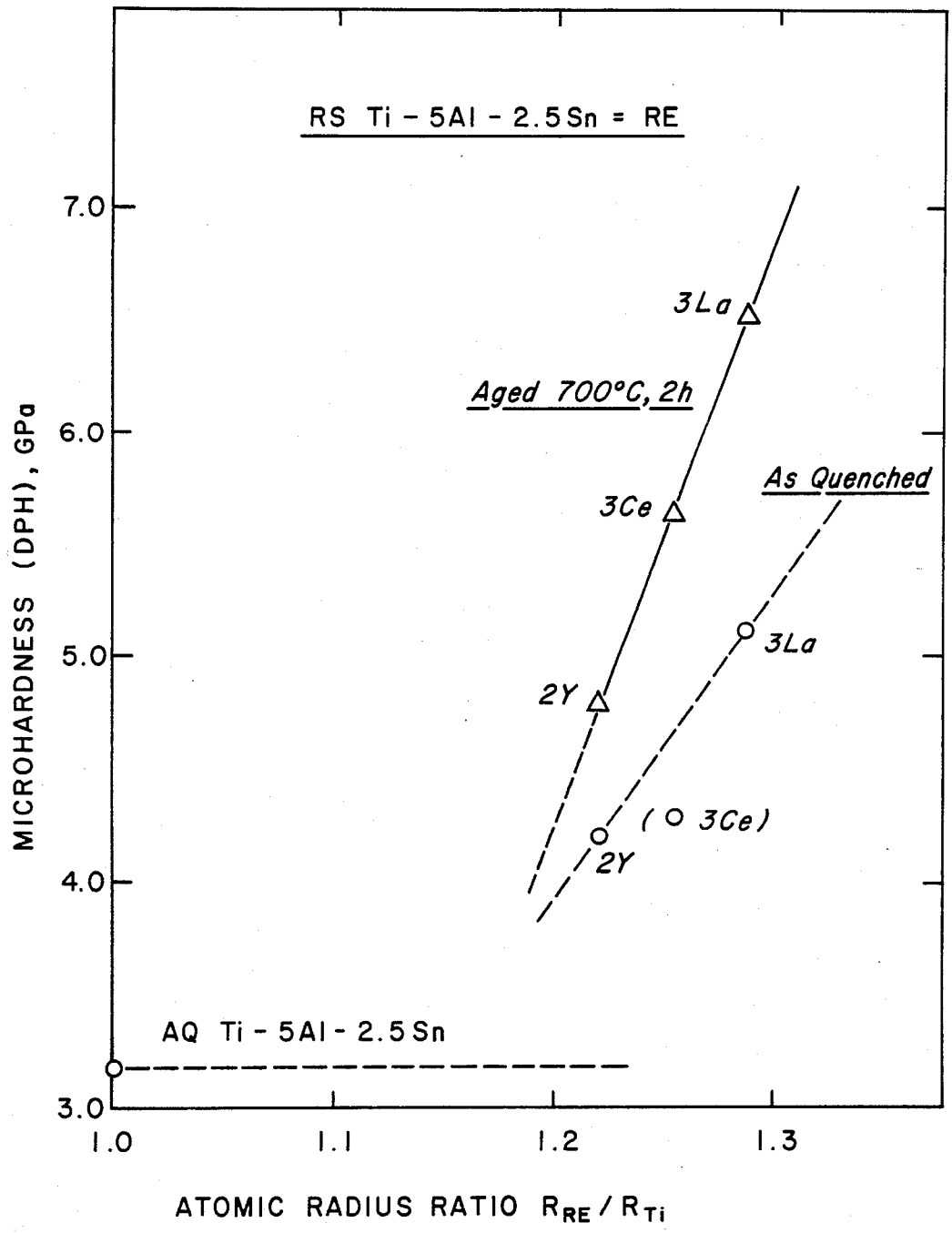
FIG. 15 is a graph showing a correlation between atomic radius of rare earth elements vs. hardness.

A correlation was found between atomic radius of rare earth elements and hardness value as shown in FIG. 15. In this figure, both correlation lines for as-quenched as well as aged samples meet with rapidly solidified Ti-5Al-2.5Sn at the range of 1.1–1.5 radius ratio ($R_{RE}/R_{Ti}$). This indicates that the strength increase due to atomic misfit is negligible when the size difference is less than 15%, which is in agreement with Hume Rather Theory of Solid Solution.

Having above indicated a preferred embodiment of the present invention, it will occur to those skilled in the art that modifications and alternatives can be practiced within the spirit of the invention. It is accordingly intended to define the scope of the invention only as indicated in the following claims.

What is claimed is:

1. A titanium base alloy containing, a IIIA, a IVA metal, and a rare earth metal having a boiling point higher than the melting point of titanium, said alloy having been rapidly quenched at a rate which permits formation of spherical precipitates in the 50–100 Angstrom diameter range from the liquid form of the alloy to prevent segregation, said alloy containing a homogeneous compound of the rare earth, a IIIA, and a IVA metal in the form of said spherical precipitates, at least some of the spherical precipitates having diameters of 50–100 Angstroms prior to any annealing step.

2. The alloy of claim 1 wherein said alloy is an alpha-alloy or a near-alpha alloy.

3. The alloy of claim 1 wherein said alloy is first rapidly solidified and then heat treated in an oxygen free atmosphere.

4. A method of increasing the strength of an alpha-titanium or near alpha-titanium alloy comprising adding to said alloy a IIIA, IVA metal and a rare earth metal having a boiling point higher than the melting point of titanium, rapidly solidifying the resulting alloy at a rate which permits formation of spherical precipitates in the 50–100 Angstrom diameter range from the liquid form of the alloy to prevent segregation whereby said allow contains a homogeneous compound of the rare earth, a IIIA and a IVA metal in the form of said spherical precipitates, at least some of the spherical precipitates having diameters of 50–100 Angstroms prior to any annealing step, and heat treating the rapidly solidified alloy in an oxygen free atmosphere.

5. The method of claim 4 wherein the atomic percent of the rare earth metal is between 0.1 at % and 2 at %.

6. The method of claim 4 wherein the amount of rare earth is below the maximum extended solubility limit of the rapidly solidified alloy.

7. The method of claim 4 wherein the rare earth is lanthanum.

8. The method of claim 4 wherein said alloy contains both aluminum and tin for stabilizing the alpha structure, and for reducing oxidation as well as for reacting chemically with the rare earth metal.

9. A precipitate-hardened alloy of alpha or near alpha titanium containing a IIIA, a IVA metal and a rare earth metal in which the precipitate takes on a spherical form, said alloy having been rapidly quenched at a rate which permits formation of spherical precipitates in the 50–100 Angstrom diameter range from the liquid form of the alloy to alleviate segregation, said alloy containing a homogeneous compound of the rare earth, a IIIA and a IVA metal, at least some of the spherical precipitates having diameters of 50–100 Angstroms prior to any annealing step.

10. The alloy of claim 9 wherein the precipitate hardening is produced by rapid solidification of the alloy followed by heat treatment.

11. The alloy of claim 10 wherein the heat treating takes place at a temperature above 500° C. for a time period in excess of two hours.

12. The alloy of claim 9 wherein said alloy also includes zirconium.

13. A titanium base alloy containing a IIIA, a IVA metal, with a small amount of a member of the group of metals consisting of Y, La, Ce, Pr, Nd, Tb, Dy, Ho, Er, Lu, Th, and Zr, wherein the concentration of said member is below its maximum extended solubility limit in titanium, said alloy having been rapidly quenched at a rate which permits formation of spherical precipitates in the 50–100 Angstrom diameter range from the liquid form of the alloy to prevent segregation, said alloy containing a homogeneous compound of the rare earth, a IIIA and a, IVA metal in the form of said spherical precipitate, at least some of the spherical precipitates having diameters of 50–100 Angstroms prior to any annealing step.

14. A titanium base alloy containing a IIIA, a IVA metal, with a small amount of a member of the group of metals consisting of Y, La, Ce, Pr, Nd, Tb, Dy, Ho, Er, Lu, Th, and Zr characterized in that said member is dispersed as a fine, uniform precipitate in the alloy, said alloy having been rapidly quenched at a rate which permits formation of spherical precipitates in the 50–100 Angstrom diameter range from the liquid form of the alloy to prevent segregation, said alloy containing a homogeneous compound of the rare earth a IIIA and a, IVA metal in the form of said spherical precipitates, at least some of the spherical precipitates having diameters of 50–100 Angstroms prior to any annealing step.

15. The alloy of claim 13 or 14 wherein concentration of said member in titanium is between 0.1 at % and 1 at %.

16. An alloy of titanium containing small amounts of aluminum, tin and lanthanum, said alloy having been rapidly quenched at a rate which permits formation of spherical precipitates in the 50–100 Angstrom diameter range from the liquid form of the alloy to prevent segregation, said alloy containing a homogeneous compound of the rare earth, a IIIA and a, IVA metal in the form of said spherical precipitates at least some of said spherical precipitates having diameters of 50–100 Angstroms prior to any annealing step.

17. An alloy of titanium containing small amounts of aluminum, a IVA metal and lanthanum, said alloy having been rapidly quenched at a rate which permits formation of spherical precipitates in the 50–100 Angstrom diameter range from the liquid form of the alloy to prevent segregation, said alloy containing a homogeneous compound of the rare earth, a IIIA and a, IVA metal in the form of said spherical precipitates, at least some of the spherical precipitates having diameters of 50–100 Angstroms prior to any annealing steps.

18. An alloy of titanium containing small amounts of aluminum, tin or germanium and cerium, said alloy having been rapidly quenched at a rate which permits formation of spherical precipitates in the 50–100 Angstrom diameter range from the liquid form of the alloy to prevent segregation, said alloy containing a homogeneous compound of the rare earth, a IIIA and a, IVA metal in the form of said spherical precipitates, at least some of the spherical precipitates having diameters of 50–100 Angstroms prior to any annealing step.

19. An alloy of titanium containing small amounts of aluminum, tin or germanium and lanthanum, said alloy having been rapidly quenched at a rate which permits formation of spherical precipitates in the 50–100 Angstrom diameter range from the liquid form of the alloy to prevent segregation, said alloy containing a homogeneous compound of the rare earth, a IIIA and a, IVA metal in the form of said spherical precipitates, at least some of the spherical precipitates having diameters of 50–100 Angstroms.

20. An alloy of titanium containing small amounts of aluminum, tin and either Y or Nd, said alloy having been rapidly quenched at a rate exceeding which permits formation of spherical precipitates in the 50–100 Angstrom diameter range from the liquid form of the alloy to prevent segregation, said alloy containing a homogeneous compound of the rare earth, a IIIA and a, IVA metal in the form of said spherical precipitates, at least some of the spherical precipitates having a diameter of 50–100 Angstroms.

21. An alloy of titanium, aluminum, tin and lanthanum having a precipitate, wherein the precipitate is spherical in form and has a particle size of approximately 50–100 Angstroms, said alloy having been rapidly quenched at a rate which permits formation of spherical precipitates in the 50–100 Angstrom diameter range from the liquid form of the alloy to prevent segregation, said alloy containing said spherical precipitate in the form of a homogeneous compound of the rare earth, a IIIA and a, IVA metal.

22. A method of making titanium alloys which includes the steps of dispersing in the alloys a small amount of a IIIA, a IVA metal and a member of the group of metals consisting of Y, La, Ce, Pr, Nd, Tb, Dy, Ho, Er, Lu, Th, and Zr and rapidly solidifying the resultant alloy at a rate which permits formation of spherical precipitates in the 50–100 Angstrom diameter range to prevent segregation, whereby said alloy contains a homogenous compound of the rare earth a IIIA, a IVA metal in the form of said spherical precipitate, at least some of the spherical precipitates having a diameter of 50–100 Angstroms.

* * * * *

UNITED STATES PATENT AND TRADEMARK OFFICE

CERTIFICATE OF CORRECTION

PATENT NO. : 4,512,826

DATED : April 23, 1985

INVENTOR(S) : Sung-Hyun Whang

It is certified that error appears in the above-identified patent and that said Letters Patent is hereby corrected as shown below:

Abstract, line 9, "allow" should read --alloy--

Column 1, line 17, "amophous" should read --amorphous--
line 29, "β-titanium" should read --α-titanium--
line 33, "β-alloys" should read --α-alloys--
lines 64-65, "paper to Sastry" should read --paper by Sastry--

Column 2, line 44, "technology along" should read --technology alone--

Column 4, line 61, "hours of temperatures" should read --hours at temperatures--

Column 6, line 14, "t his" should read --this--
line 51, "land" should read --and--

Column 7, line 28, "aloys" should read --alloys--
line 38, "sucgh" should read --such--
line 56, "Figs. 7a and 7b Figs. 8a 8b" should read --Figs. 7a and 7b and Figs. 8a and 8b--

Column 8, line 18, "addition increases" should read --addition further increases--
line 44, "microstrucural" should read --microstructural--

Column 9, line 44, "earth, a IIIA, and a IVA" should read --earth and the IIIA, a IVA--
line 60, "allow" should read --alloy--

UNITED STATES PATENT AND TRADEMARK OFFICE

CERTIFICATE OF CORRECTION

PATENT NO. : 4,512,826

DATED : April 23, 1985

INVENTOR(S) : Sung-Hyun Whang

It is certified that error appears in the above-identified patent and that said Letters Patent is hereby corrected as shown below:

| | | |
|---|---|---|
| Column 10, | lines 38-39, | "earth, a IIIA and a, IVA" should read --earth, a IIIA and a IVA-- |
| | lines 53-54, | "earth a IIIA and a, IVA" should read --earth, a IIIA and a IVA-- |
| | line 65, | "earth, a IIIA and a IVA" should read --earth, a IIIA and a IVA-- |
| Column 11, | line 7, | "earth, a IIIA and a, IVA metal" should read --earth, a IIIA and a IVA metal-- |
| | line 17, | "earth, a IIIA and a, IVA metal" should read --earth, a IIIA and a IVA metal-- |
| | line 27, | "earth, a IIIA and a, IVA metal" should read --earth, a IIIA and a IVA metal-- |
| Column 12, | lines 5-6, | "earth, a IIIA and a, IVA metal" should read --earth, a IIIA and a IVA metal-- |
| | lines 18-19, | "earth, a IIIA and a, IVA metal" should read --earth, a IIIA and a IVA metal-- |

Signed and Sealed this

Fourth Day of November, 1986

[SEAL]

*Attest:*

DONALD J. QUIGG

*Attesting Officer*

*Commissioner of Patents and Trademarks*